United States Patent [19]

Schulze

[11] Patent Number: 4,949,623

[45] Date of Patent: Aug. 21, 1990

[54] HYDRAULIC DRIVE MECHANISM

[75] Inventor: Eckehart Schulze, Weissach-Flacht, Fed. Rep. of Germany

[73] Assignee: Hartmann & Lammle GmbH & Co. KG, Rutesheim, Fed. Rep. of Germany

[21] Appl. No.: 318,323

[22] Filed: Mar. 3, 1989

[51] Int. Cl.[5] ..... F01L 25/02

[52] U.S. Cl. ..... 91/286; 91/303; 91/304; 91/313; 91/420

[58] Field of Search ..... 91/274, 281, 286, 303, 91/304, 308, 313, 420, 461, 464, 358 R

[56] References Cited

U.S. PATENT DOCUMENTS

| | | | |
|---|---|---|---|
| 2,803,110 | 8/1957 | Chittenden | 91/304 X |
| 2,974,639 | 3/1961 | O'Connor et al. | 91/464 X |
| 3,951,042 | 4/1976 | Weiss | 91/363 R |
| 4,184,331 | 1/1980 | Bentley | 91/304 X |

FOREIGN PATENT DOCUMENTS

| | | | |
|---|---|---|---|
| 52-4976 | 1/1977 | Japan | 91/308 |
| 868771 | 5/1961 | United Kingdom | 91/308 |

*Primary Examiner*—Edward K. Look

*Attorney, Agent, or Firm*—Antonelli, Terry, Stout & Kraus

[57] ABSTRACT

Hydraulic drive mechanism for a machine element with rapid feed movement and under-load feed movement, comprising a double-acting hydrocylinder power drive and a pressure switching valve responding to the pressure at least in a larger operating chamber of the hydrocylinder when the pressure in the operating chamber exceeds a threshold value higher than ¼ of the operating pressure of the pressure supply source, but lower than half the operating pressure thereof, switches to underload feed operation and, when the pressure in the drive pressure or operating chamber falls below the threshold value, switches back to rapid feed operation. The pilot valve for the main control valve is equipped with two windings effective in opposite directions. A switching device is included which, in a position- or time-controlled fashion, excites the second control winding, and a return signaling stop is provided which brings about, in the point of reversal of the piston movement of the hydrocylinder on the workpiece side, a mechanical switchover of the pilot valve into the position required for the retraction movement.

5 Claims, 5 Drawing Sheets

HYDRAULIC DRIVE MECHANISM

The invention relates to a hydraulic drive mechanism and, more particularly, to a hydraulic drive mechanism for a machine element carrying a treatment tool for executing a rapid feed movement directed toward a workpiece to be treated, and under-load feed movement directed in the same direction during a treatment of the workpiece, subsequently thereto optionally again a rapid feed movement and, after reversal of direction of movement, a rapid retraction movement up to an end and initial position for further treatment, respectively.

Hydraulic drive mechanisms of the aforementioned type have been proposed which include a power drive means designed as a double-acting hydraulic cylinder, the movement strokes of which are controlled by a pressure pilot-controlled main control valve which, in turn, is pilot controlled by a solenoid valve wherein a piston of the power drive means, in the rapid feed operation, is pressurized on a larger working surface $A_1$ and on a smaller annular countersurface $A_2$, and wherein, in the under-load feed operation, only on its larger piston area $A_1$, while the smaller piston area $A_2$ is relieved, and wherein, in a rapid retraction operation, only its smaller piston area $A_2$ while the larger piston area is pressure-relieved.

Hydraulic drive mechanisms of the aforementioned type have been proposed but have a number of disadvantages or drawbacks. More particularly, one disadvantage resides in the fact that uncontrollable movements occur during a reversal in the workpiece-proximate turning point of the movements of a hydraulic or hydrocylinder provided as a power drive means due to decompression of the enclosed oil volume. The uncontrollable movements lead to undesirably long operating strokes and are also connected with a considerable noise generation. The undesirably long operating strokes result in undesirably long cycle periods; whereas, the considerable noise generation must be addressed in terms of regulations protecting employees' with regard to safety standards which standards can be met not at all or only at a maximum expense.

Therefore, it is an object of the present invention to improve a hydraulic drive mechanism of the type discussed hereinabove with the goal of obtaining shorter operating cycle times, as well as largely avoiding vibrations in the turning points of the respective movements of the hydrocylinder and the tool.

In accordance with advantageous features of the present invention, a pressure switching valve is provided which responds to a pressure at least in the larger operating chamber of the drive hydrocylinder. The pressure switching valve switches to under-load feeding operation when the pressure in the operating chamber exceeds a threshold value higher than one quarter of the operating pressure of the pressure supply source but lower than one half the operating pressure thereof. When the pressure in the drive pressure chamber again falls below the predetermined threshold value, the pressure switching valve switches back to a rapid feed operation wherein both operating chambers of the hydrocylinder are pressurized. The pilot valve providing pressure pilot control for the main control valve is equipped with two control windings effective in opposite directions wherein, by excitation of one of the control windings, the pilot valve is controlled into a position provided for feed movements and thereby the feed operation is initiated. A switching device is provided which, in a position or time-control fashion, excites the second control winding acting in the opposite direction after the first control winding has been excited. Additionally, a return signaling stop is included which brings about, in the point of reversal of the piston movement of the hydrocylinder on the workpiece side, a mechanical switch over the pilot valve into the position required for the retraction movement.

One advantage of the drive mechanisms of the present invention resides in the fact that due to the fact that switching over from the feed movement to the retraction movement takes place in any event via an operating phase wherein pressure has been built up in both operating chambers of a double-acting hydraulic cylinder utilized as the power drive means, the aforementioned decompression phenomena are not only avoided but, at the same time, a gentle entrance, as it were, of the hydrocylinder into the reversal position of its piston close to the workpiece is achieved as well. Since the piston is always enclosed between pressurized pressure chambers, an uncontrolled "penetration" through the workpiece during a punching step is reliably precluded. At the same time, the slow-down stroke of the hydrocylinder is kept to a minimum by the very quickly occurring switch-over of the pilot valve which latter is "prepared" to effect very fast reversal by excitation of its second control winding, and as a result the operating cycle period is reduced to a minimum.

In accordance with still further features of the present invention, a return signaling stop is provided which, in the point of reversal of movement of the piston of the hydrocylinder remote from the workpiece, controls the main control valve into a position wherein the larger operating chamber of the hydrocylinder is sealed off against the pressure supply outlet as well as against a tank of the pressure supply source. The smaller operating chamber is connected to the pressure supply connection of the pressure supply source.

By virtue of the last mentioned features of the present invention a "gentle" entrance of the hydrocylinder into its end position remote from the workpiece is attained in a very simple manner. Moreover, it is also possible by virtue of such features to achieve a vibration-free operation of the drive mechanism.

In accordance with the present invention, a pressure switching valve is advantageously integrated into the plunger of the main control valve. With such a construction, an advantageous arrangement of the pressure switching valve providing changeover from rapid feed operation to under-load feed operation is provided.

The pressure switching valve may, in accordance with the present invention, comprise a differential piston which is displaceably guided in a stepped bore of the plunger of the main control valve. The differential piston defines, within the smaller bore stage, a first control chamber and, within a wider bore stage, a second control chamber, with the control chambers communicating with each other by way of an axial bore in the differential piston. A compression spring is arranged in the smaller control chamber and is supported against the plunger of the main control valve and against the differential piston of the pressure switching valve which deploys a resetting force $F_f$ determined in accordance with the following relationship:

$$F_f \approx \Delta A \cdot p \cdot \frac{A_2}{A_1} \cdot 0.9,$$

wherein:

$\Delta A$=an area difference of the piston stages of the differential piston;

$A_1$ and $A_2$=the larger and smaller areas, respectively, of the hydrocylinder piston; and p=the operating pressure of the pressure supply source.

It is also possible in accordance with the present invention for the reversal points of the feeding and retraction movements to be predetermined by adjustable return signaling stops. By virtue of this arrangement, the feeding and retraction strokes of the tool motion can be predetermined in a simple manner.

The above and other objects, features, and advantages of the present invention will become more apparent from the following description when taken in connection with the accompanying drawings which show, for the purpose of illustration only, one embodiment in accordance with the present invention.

FIG. 1 is a hydraulic equivalent circuit diagram of a drive mechanism according to this invention with a main control valve pressure pilot-controlled by a pilot valve designed as a solenoid valve, including an integrated pressure switching valve, and FIG. 2 through 5 are partial cross-sectional views details of the pilot valve and of the main control valve of the mechanism according to FIG. 1 for various operating phases thereof.

DETAILED DESCRIPTION

Figure 1:
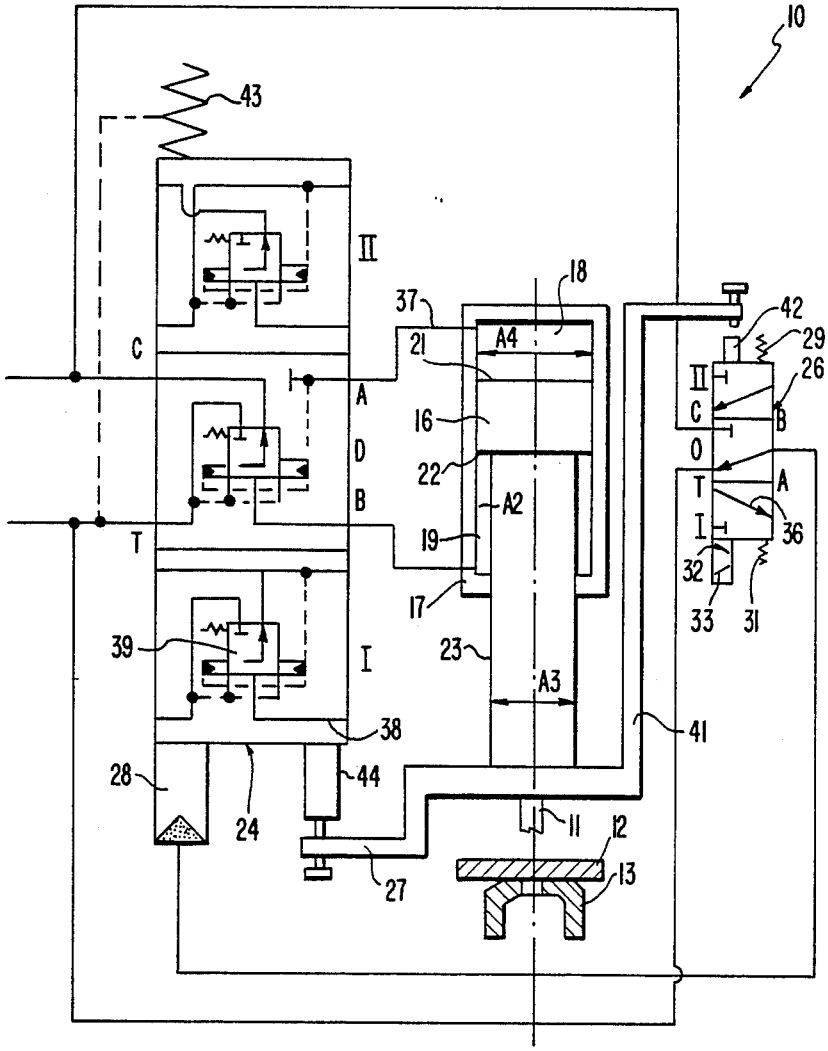

Referring now to the drawings where in like reference numerals are used throughout the various views to designate like parts and, more particularly, to FIG. 1, according to this figure, a hydraulic drive mechanism generally designated by the reference numeral 10 is, in the illustrated embodiment, associated with a punching machine which includes a dye 11 for punching a workpiece in, optionally repeated operating cycles, so as to produce cutouts from the workpiece 12 in, for example, a predetermined pattern or along a predetermined contour if the punching machine is designed as a so called nibbling machine by means of which the workpieces 12 are to be punched out of a metal panel, with the outer contour of the workpieces corresponding approximately to a desired contour. The workpiece 12 is supported in a conventional manner on a matrix 13.

Figure 2:
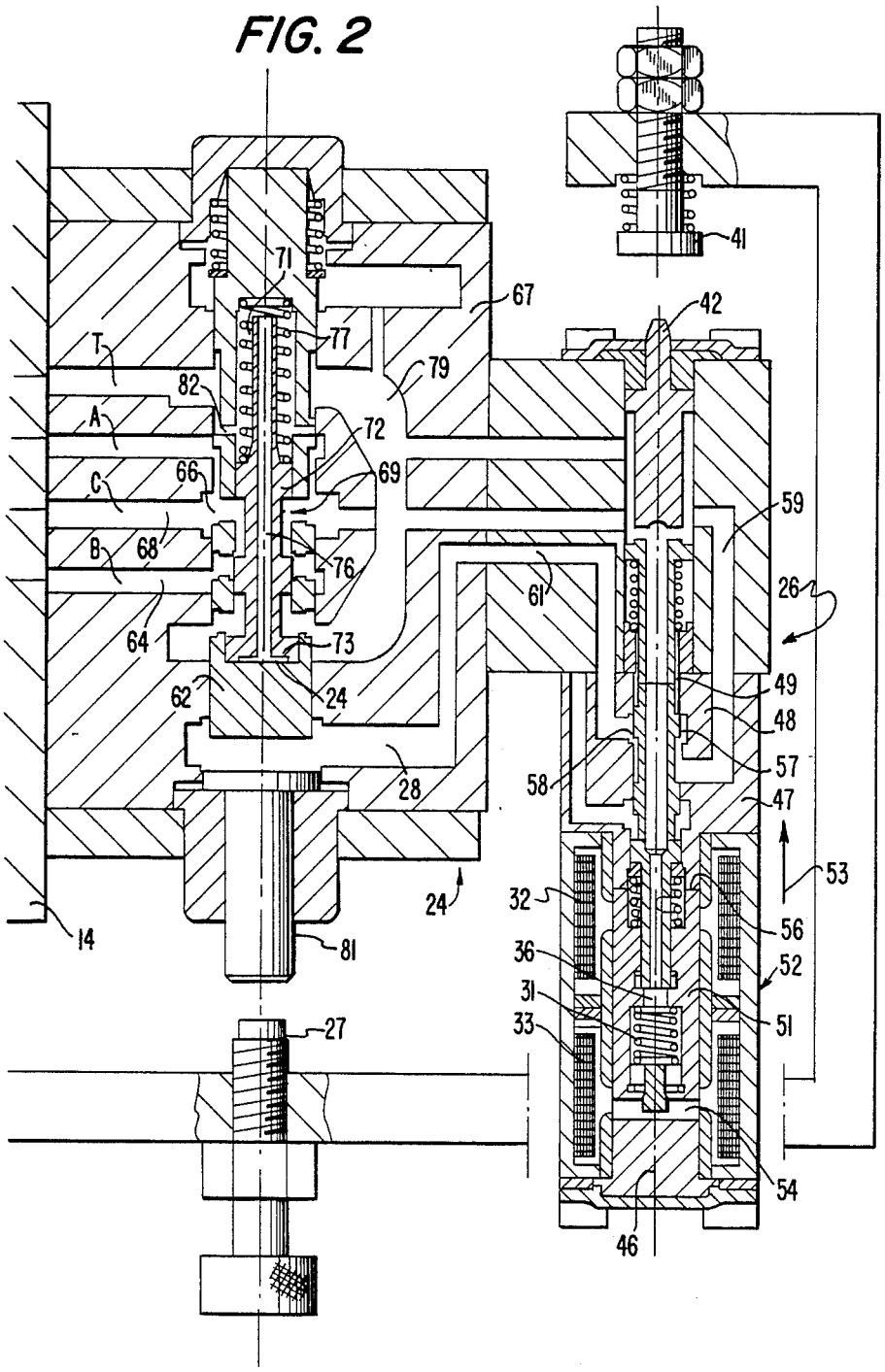

The drive mechanism 10, as shown most clearly in FIGS. 1 and 2 comprises, as the power drive element, a conventional double-acting hydraulic cylinder 14 having a piston 16 of which defines within the housing 17 a first, circular-cylindrical operating chamber 18 as well as a second operating chamber 19 having the shape of a circular ring cylinder. A circular piston area 21 of piston 16, defining one of the operating chambers, namely the larger operating chamber 18, is presumed to have a value of $A_1$. The piston area 22, delimiting the other ring-cylindrical operating chamber 19, is presumed to have the value $A_2$ which is smaller, by the cross-sectional area $A_3$ of the piston rod 23 passing through the annular operating chamber 19 and carrying the tool 11 on its free end, than the cross-sectional area $A_1$ of the larger operating chamber 18.

The drive mechanism 10 constructed in accordance with the present invention has a number of possible operating conditions. More particularly, the drive mechanism 10 has a rapid feed operation wherein the tool 11 approaches the workpiece 12 at a rapid rate, and an under-load feed operation wherein the tool 11 enters the workpiece 12 and penetrates into the workpiece 12. In the under-load feed operation, the drive element 14 must deploy a feeding power that is increased as compared with the rapid feed operation.

The drive mechanism 10 also is capable of a further rapid operation condition optionally following thereafter, prevailing to a "bottom" end position of the tool 11. The rapid operating phase can, in turn, take place with a reduced power of the hydrocylinder characteristic for the rapid feed operation. Moreover, the drive mechanism 10 is capable of a rapid retraction operating condition wherein the piston 16 of the hydrocylinder and, with the piston 16, the tool again enters into a top end position, as well as a dwell operating condition wherein the piston 16 of the hydrocylinder 14 is maintained at a top end position until a renewed operating cycle is to be initiated.

To regulate these various operating phases of the drive mechanism 10, a main control valve generally designated by the reference numeral 24 is provided, with the control valve 24 being advantageously constructed as a multiple-way valve pressure pilot-controlled by a pilot valve 26.

Furthermore, the main control valve 24 can be switched under the control of a return signaling stop 27 connected with the piston rod into the position linked to the dwell operating condition or starting position 0 (FIG. 1). In the starting or basic position 0, the larger operating chamber 18 is sealed off and the smaller operating chamber 19 is in communication with the pressure connection C of the operating pressure supply source (not shown). In this holding phase, with the aforementioned area proportions of the piston areas $A_1$ and $A_2$, the pressure in the larger operating chamber 18 corresponds to half the operating pressure of the supply source. The piston 16 remains, so to speak, "clamped in place" in its top end position. In this phase, the pilot valve 26 is in its illustrated basic position wherein the control pressure chamber 28 of the main control valve 24 is connected via the pilot valve 26 to the tank T of the pressure supply source.

This basic position of the pilot valve 26 is achieved by spring-centering of its piston by two centering springs 21 and 31. The centering springs 21, 31 retain the valve plunger of the pilot valve 26, fashioned as a solenoid valve comprising two control windings 32 and 33 acting in opposite directions, in a basic position 0 when these control windings 32 and 33 are not excited.

The pilot valve 26 is switched into its energized position I by electrical activation of one of the control windings 32. In this energized position, the control pressure chamber 28 of the main control valve 24 is placed in communication, via the passage route 36 of the pilot valve 26, with the pressure supply connection P of the pressure supply source. Thereby the main control valve enters its functional position denoted by I in FIG. 1 wherein the circular-cylindrical, larger operating chamber 18 as well as the smaller, ring-cylindrical operating chamber 19 of the hydrocylinder 14 are connected to the pressure supply connection C of the pressure supply source. The piston 16 of the hydrocylinder and therewith the tool 11 at this point in time execute the advance in rapid mode directed toward the workpiece 12. During this procedure, the larger operating chamber 18 is directly connected to the presssure supply connection C via a first passage route 37 of the main control valve 24; whereas, the passage route 38 leading to the smaller working chamber 19, extends by way of a pressure switching valve 39 integrated into the plunger of the main control valve 24. The pressure switching valve 39, once the pressure in the larger working chamber 18 exceeds a predetermined threshold value, changes over into a throughflow position alternative with respect to the illustrated throughflow position wherein the smaller working chamber 19 is in communication with the tank of the pressure supply source via the pressure switching valve 39. In this position assumed by the changeover of the pressure switching valve 39, the larger operating chamber 18 is thus connected to the pressure supply connection C, and the smaller operating chamber 19 is connected to the tank of the pressure supply source. In this functional position of the main control valve 24 and of the pressure switching valve 39 integrated into its plunger, the under-load feed operation takes place wherein the die 11 can penetrate the workpiece 12 with increased driving power.

The pressure switching valve 39 is designed, in a specific structure, so that switchover takes place when the pressure in the larger working chamber has a value that is lower by about 10% than the value $P\cdot(A_2/A_1)$ wherein P equals the operating pressure of the pressure supply source.

As soon as the workpiece 12 is, so to speak, "torn" and thereby the pressure in the larger working chamber 18 decreases again because the mechanical resistance against which the hydrocylinder 14 operates has become smaller, the pressure switching valve 39 drops again into the illustrated basic position 0, and the piston 16 of the hydrocylinder 14 is again moved on at rapid rate up into its bottom end position. Once the piston of the hydrocylinder 14 has entered a bottom end position, a second return signaling stop 41, connected to the piston 16 and, respectively, the piston rod 23, of the hydrocylinder 14, changes over the pilot valve 26 from its excited position I into the second energized position II which is an alternative thereof and corresponds functionally to the basic position 0, wherein, in turn, the control pressure chamber 28 of the main control valve 24 is in communication with the tank of the pressure supply source.

In order to obtain rapid response of the pilot valve 26 to the abutting of the return signaling stop 41 against its mechanical operating member 42, the second control winding 33 of the pilot valve, acting in opposition to the first control winding 32, has been energized previously, i.e. even during the feeding operation at rapid rate. However, excitation of the second control winding 33 will have no influence on the position of the plunger of the pilot valve 26 as long as this plunger is in its energized position I inasmuch as the control windings 32 and 33 are designed so that, assuming simultaneous excitation of both control windings, 31, 32 the plunger of the pilot valve 26 remains respectively in the position wherein it has been placed by the first-occurring energization of one or the other control winding 32 or 33. With this type of excitation of the second control winding 33 after excitation of the first control winding 32, the pilot valve 26 is "flipped" easily and quickly into the second excited position II by a slight "thrust" exerted by the return signaling stop 41 on the operating member 42 of the pilot valve 26.

After the control pressure chamber 28 of the main control valve 24 has been pressure-relieved, by the switch-over of the pilot valve 26, the main control valve 24 enters, by the action of its resetting spring 43, into the position II linked to retraction in rapid mode wherein now the larger operating chamber 18 of the hydraulic cylinder 14 is connected to the tank and the smaller,ring-cylindrical operating chamber 19 of the hydraulic cylinder is solely still connected to the pressure supply connection C of the pressure supply source.

The upward movement proceeds until the first return signaling stop 27 meets the mechanical operating member 44 of the main control valve in the "top dead center position" of the piston or, respectively, tool movement, and the main control valve 24 passes thereby into the basic position 0.

In the meantime, i.e. after the upward stroke has been initiated, but the piston 16 of the hydrocylinder 14 is still "far remote" from the top end position, excitation of the second control winding 33 of the pilot valve 26 is discontinued by for example, a position-dependent switch-over of an electric switch or by time control by a time delay member bringing about deenergization of the second control winding 33 in relation to a specific duration of the operating cycle, whereby the pilot valve 26 reenters the basic position 0 before the piston 16 of the hydrocylinder 14 has reached its top end position.

In FIG. 2, the main control valve 24 and the pilot valve 26 are illustrated with those plunger positions corresponding to the feeding operation of the hydrocylinder 14 at rapid rate.

In the housing 47 of the pilot valve 26, the valve plunger 48 is arranged, as seen in the direction of the central longitudinal axis 46 of the valve, to be displaceable upwards and downwards in the housing bore 49. The plunger 48 is fixedly joined to the armature 51 of an operating or activating magnet generally designated by the reference numeral 52 of the pilot valve 26. The actuating magnet 52 is provided with the two magnet windings 32 and 33 which, as shown in FIG. 2, are arranged in a superimposed relationship. By electric excitation of the upper control winding 32, the armature 51 is subjected to displacement in the direction of arrow 53, i.e. upwardly. By alternative energization of the lower control winding 33, the armature 51 is subjected to displacement in the downward direction up to its bottom end position determined by a stop surface 54. In the illustrated operating position, the upper control winding 32 is excited and thereby the plunger 48 is urged into its top end position which is, in turn, defined by abutment of the armature 51 against a top abutment surface 56. In this position of the plunger 48, the mechanical operating member 42, which can cooperate with the return signaling stop 41, is likewise urged into an end position projecting out of the housing 47 of the pilot valve 26. In the illustrated top end position of the plunger 48, an annular groove 57 of the housing 47 is in communication, via a control edge 58 of the plunger 48, on the one hand with the connection of the duct 59 and, on the other hand, via the control duct 61 with the control pressure chamber 28 of the main control valve 24. Thereby, the plunger 62 of the main control valve 24 is urged into its end position which is at the top in FIG. 2. In this end position of the plunger 62, the A control duct 63 and the B control or connection duct 64, leading to the larger working chamber 18 and to the smaller working chamber 19 of the hydrocylinder 14, are in communication with an annular groove 66 of the housing 67 of the main control valve 24 to which the supply duct 68 is connected. In this position, both operating chambers 18 and 19 of the hydrocylinder 14 are connected to the pressure supply source.

The pressure switching valve 39 integrated into the plunger 62 of the main control valve 24 has a differential piston generally designated by the reference numeral 69 with a piston step 72 of the differential piston 69, smaller in diameter, defining within the plunger 62 an upper control chamber 71, and the piston step 73 of the piston, wider in diameter, movably defining a second control chamber 74 on the opposite side. The two control chambers 71 and 74 communicate with each other by way of a longitudinal bore 76 of the differential piston 69. A compression spring 77:5 supported on the plunger 62 and on the differential piston 69 within the upper control chamber and urges the piston 69 of the pressure switching valve into the illustrated, bottom end position within the plunger 62. The upper control pressure chamber communicates in any possible position of the differential piston 69 as well as of the plunger 62 of the main control valve 24 with the A control duct 63. Upon an increase in pressure in the control pressure chamber 71 and thus also in the pressure chamber 74 having the larger cross-sectional area, the differential piston 69 is shifted upwardly according to FIG. 2, against a restoring force of the spring 77.

Figure 3:
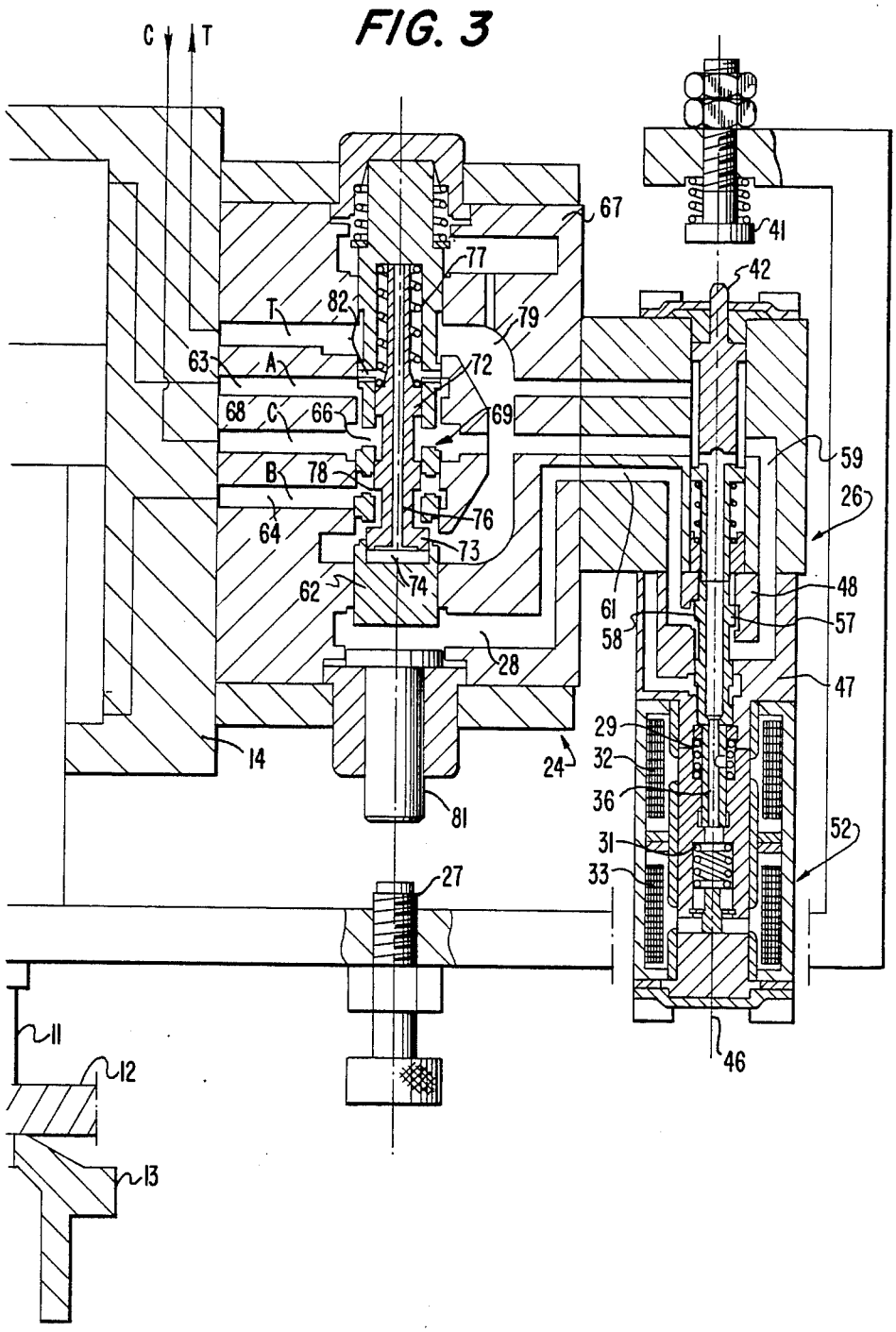

Thereby, the differential piston 69 then enters the position shown in FIG. 3 wherein its control edge 78 affords communicating connection between the B control or connection duct 64 and the tank chamber 79 of the main control valve 24. At the same time, the previously established communicating connection between the P connection duct 68 and the B control duct 64 is interrupted. The smaller working chamber 19 of the hydraulic cylinder 14 is then pressure-relieved, and the system operates in the under-load feed operation.

Figure 4:
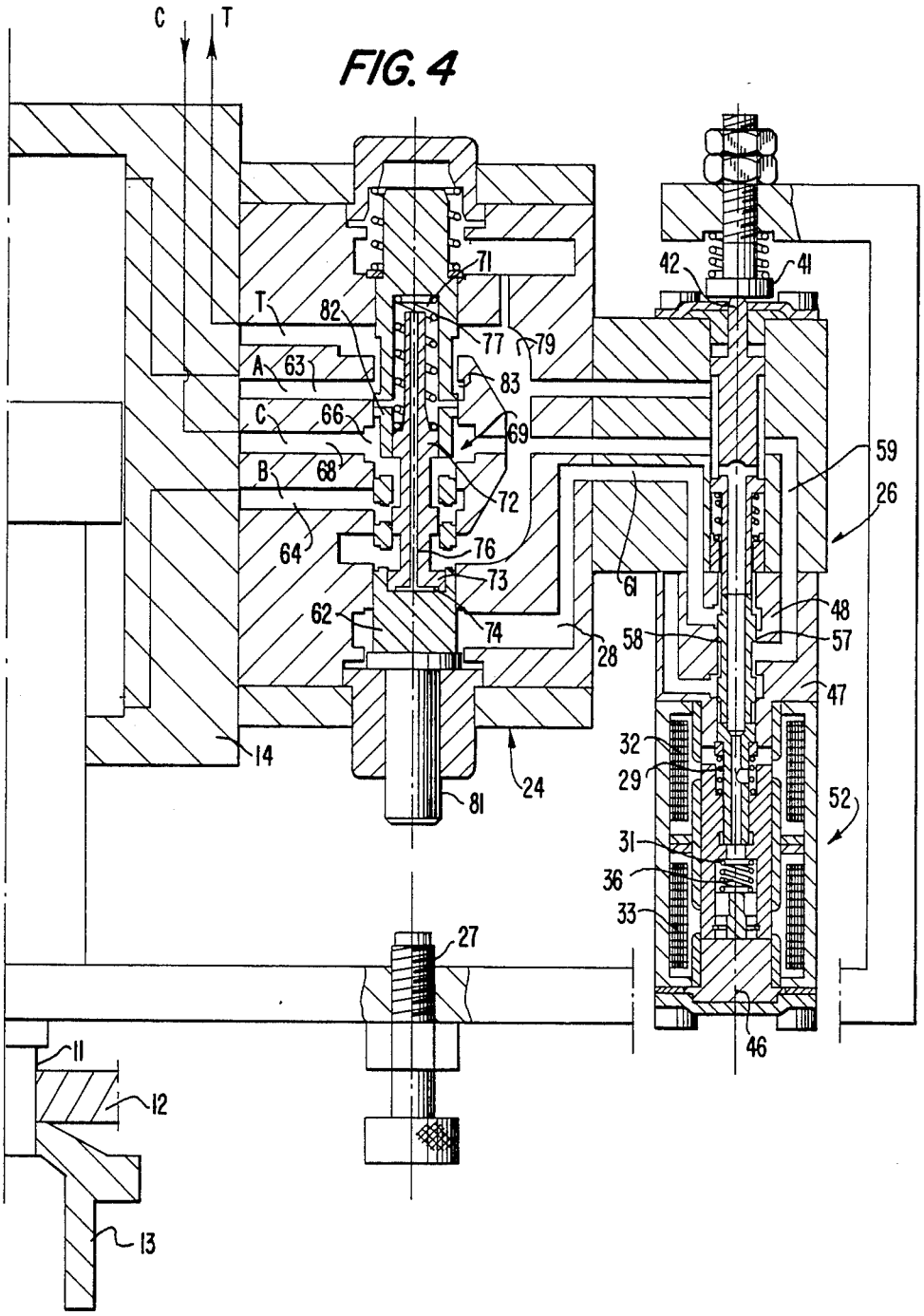
Figure 5:
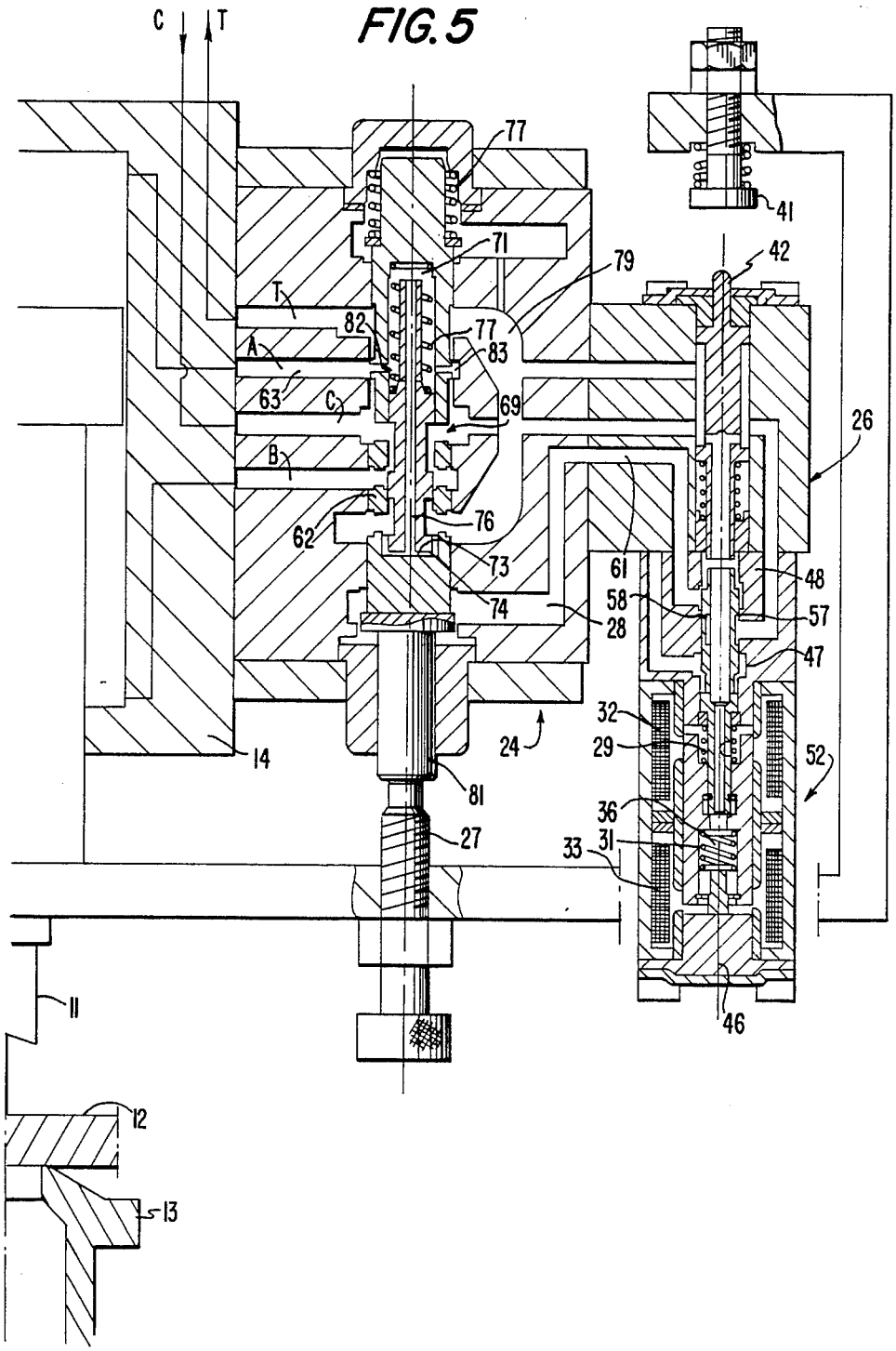

FIG. 4 shows the plunger positions of the pilot valve 26 and of the main control valve 24 in the lower reversal point of the movement of piston 16 of the hydrocylinder 14. The pilot valve 26 is switched, by the return signaling stop 41 into the operational position wherein its control duct 61 and thus also the control pressure chamber 28 of the main control valve 24 are connected by way of the tank chamber 79 of the main control valve 24 to the tank of the pressure supply source. The plunger 62 of the main control valve 24 thereby passes into its lower end position—due to the effect of the resetting spring 43 of the main control valve 24. In this end position of the plunger 62, there is merely a communicative connection between the B control duct 64 of the main control valve 24 and the C supply duct 68. At this point, the retraction movement of the hydrocylinder 14 is initiated in rapid rate until, as illustrated in FIG. 5, the first return signaling stop 27 runs up against a push rod 81 which now shifts the plunger 62 of the main control valve 24 again "upwardly". As soon as the control edge 82 of plunger 62 topmost in FIG. 5 has, during this step, moved past the annular groove 83 within which the A control duct 63 terminates into the valve bore, the previously open connection of the control duct 63 with the tank is interrupted, and the larger working chamber 18 of the hydrocylinder 14 is blocked off. The piston 16 of the hydrocylinder 14 then is arrested in the attained position as soon as a pressure has been built up, in the selected example for explanatory purposes, in this larger pressure chamber 18 which corresponds to half the operating pressure of the pressure supply source.

Even before the piston 16 of the hydrocylinder 14 has entered into its upper end position, the excitation also of the second control winding 33 of the pilot valve 24 is cut off whereby its plunger enters into the central position zero determined by the two springs 29 and 31.

I claim:

1. Hydraulic drive mechanism for a machine element carrying a treatment tool executing a rapid feed operation directed toward a workpiece to be treated, and under-load feed operation directed in the same direction during a treatment of the workpiece, subsequently thereto optionally again a rapid feed operation and, after reversal of direction of movement, a rapid retraction operation up into an end and, respectively, an initial position for further treatment, the hydraulic drive mechanism includes power drive means including a double-acting drive hydrocylinder means having a piston means adapted to execute movement strokes, a pressure pilot-controlled main control valve means for controlling a movement of the piston means, and a solenoid valve means for pilot controlling the main control valve means, the piston means includes a large piston area and the smaller annular counter piston area, wherein, in the rapid feed operation, the piston means is pressurized on the larger piston area and on the smaller counter piston area, in the under-load feed operation only the larger piston area is pressurized while the smaller piston area is relieved, and in the rapid retraction operation only the smaller piston area is pressurized while the larger piston area is pressure-relieved, characterized in that the piston means divides the hydrocylinder into a large operating chamber and a small operating chamber, a pressure switching valve means is provided which is responsive to a pressure at least in the large operating chamber of the drive hydrocylinder, said pressure switching valve means switching to the under-load feed operation when the pressure in the large operating chamber exceeds a threshold value higher than one-quarter of an operating pressure of a pressure supply source but lower than one-half the operating pressure thereof, and, when the pressure in the large operating chamber again falls below the threshold value, switches back to the rapid feed operation wherein both operating chambers are pressurized, said solenoid valve means providing pressure pilot control for the main control valve means includes two control windings effective in opposite directions wherein, by excitation of one of the control windings, the solenoid valve means is controlled into a position provided for the feed operations and thereby the feed operation is initiated, a switching means is provided which, in one of a position-controlled and time-controlled fashion, excites the second control winding acting in the opposite direction after the first control winding has been excited, and in that a return signalling stop means is provided for bringing about, in a point of reversal of a movement of the piston means of the hydrocylinder means on a side of the workpiece, a mechanical switchover of the solenois valve means into a position required for the retraction operation.

2. Hydraulic drive mechanism according to claim 1, characterized in that a return signalling stop means is provided which, in the point of reversal of movement of the piston means of the hydrocylinder means remote from the workpiece, controls the main control valve means into a position wherein the large operating chamber is sealed off against a pressure supply outlet as well as against a tank of the pressure supply source and the small operating chamber is connected to a pressure supply connection of the pressure supply source.

3. Hydraulic drive mechanism according to one of claims 1 or 2, characterized in that the pressure switching means is integrated into a plunger means of the main control valve means.

4. Hydraulic drive mechanism according to claim 3, characterized in that the pressure switching valve means comprises of differential piston means displaceably guided in a stepped bore of the plunger means of the main control valve means, the differential piston means defines within a smaller bore stage a first control chamber and within a wider bore stage a second control chamber, said first and second control chambers communicate with each other by an axial bore means in the differential piston means, and in that, within the first control chamber, a compression spring is arranged which is supported against the plunger means of the main control valve means and against the differential piston means of the pressure switching valve means, said compression spring means has a resetting force $F_f$ determined by the following relationship:

$$F_f \approx \Delta A \cdot p \cdot \frac{A_2}{A_1} \cdot 0.9,$$

wherein:

$\Delta A$ = an area difference piston stages of the differential means, $A_1$, $A_2$ = the large and small piston areas of the hydrocylinder piston means, and p = an operating pressure of the pressure supply source.

5. Hydraulic drive mechanism according to claim 4, characterized in that adjustable return signaling stop means are provided for predetermining reversal points of the feeding and retraction movements.

* * * * *